US010434366B2

(12) United States Patent
Dungee

(10) Patent No.: US 10,434,366 B2
(45) Date of Patent: Oct. 8, 2019

(54) COLLAPSIBLE EXERCISE ASSEMBLY

(71) Applicant: Michael Dungee, Brooklyn, NY (US)

(72) Inventor: Michael Dungee, Brooklyn, NY (US)

( * ) Notice: Subject to any disclaimer, the term of this patent is extended or adjusted under 35 U.S.C. 154(b) by 130 days.

(21) Appl. No.: 15/628,056

(22) Filed: Jun. 20, 2017

(65) Prior Publication Data

US 2018/0361201 A1 Dec. 20, 2018

(51) Int. Cl.

| | |
|---|---|
| ***A63B 23/12*** | (2006.01) |
| ***A63B 21/068*** | (2006.01) |
| ***A63B 21/00*** | (2006.01) |
| ***A63B 17/04*** | (2006.01) |
| *A63B 1/00* | (2006.01) |

(52) U.S. Cl.

CPC ..... *A63B 23/1227* (2013.01); *A63B 17/04* (2013.01); *A63B 21/00047* (2013.01); *A63B 21/068* (2013.01); *A63B 1/00* (2013.01); *A63B 23/12* (2013.01); *A63B 23/1209* (2013.01); *A63B 2210/50* (2013.01); *A63B 2225/09* (2013.01); *A63B 2225/093* (2013.01)

(58) Field of Classification Search

CPC ..... A63B 21/00047; A63B 21/068; A63B 23/1227; A63B 23/12; A63B 23/1209; A63B 2225/093; A63B 2225/09; A63B 2210/50; A63B 1/00; A63B 3/00; A63B 17/04

See application file for complete search history.

(56) References Cited

U.S. PATENT DOCUMENTS

| | | | | |
|---|---|---|---|---|
| 5,096,187 | A | 3/1992 | Marpels | |
| 5,454,771 | A * | 10/1995 | Wilson-Hyde | A63B 21/00047 248/240.4 |
| 6,248,048 | B1 | 6/2001 | Zuckerman et al. | |
| 7,651,449 | B1 | 1/2010 | Balentine | |
| D617,400 | S | 6/2010 | Hetzel et al. | |
| 8,317,664 | B2 | 11/2012 | Gorsuch et al. | |
| 9,138,609 | B2 | 9/2015 | Placide | |
| 2003/0004042 | A1 * | 1/2003 | Burrell | A63B 21/00047 482/121 |
| 2012/0231937 | A1 | 9/2012 | Murphy | |
| 2018/0221700 | A1 * | 8/2018 | George | A63B 21/068 |

FOREIGN PATENT DOCUMENTS

| | | |
|---|---|---|
| WO | WO1997033656 | 9/1997 |

* cited by examiner

*Primary Examiner* — Megan Anderson

(57) ABSTRACT

A collapsible exercise assembly for performing dip exercises includes a pair of uprights that may each be vertically oriented on a support surface. Each of the uprights may be gripped thereby facilitating dip exercises to be performed. A folding unit is coupled between the pair of uprights. The folding unit is selectively positioned in a deployed position having the uprights being spaced a selected distance apart from each other. The folding unit is selectively positioned in a folded position having each of the uprights being spaced a minimum distance apart from each other.

16 Claims, 6 Drawing Sheets

COLLAPSIBLE EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for performing dip exercises.

(2) Description of Related Art Including Information Disclosed Under 37 CFR 1.97 and 1.98

The prior art relates to exercise devices.

BRIEF SUMMARY OF THE INVENTION

An embodiment of the disclosure meets the needs presented above by generally comprising a pair of uprights that may each be vertically oriented on a support surface. Each of the uprights may be gripped thereby facilitating dip exercises to be performed. A folding unit is coupled between the pair of uprights. The folding unit is selectively positioned in a deployed position having the uprights being spaced a selected distance apart from each other. The folding unit is selectively positioned in a folded position having each of the uprights being spaced a minimum distance apart from each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
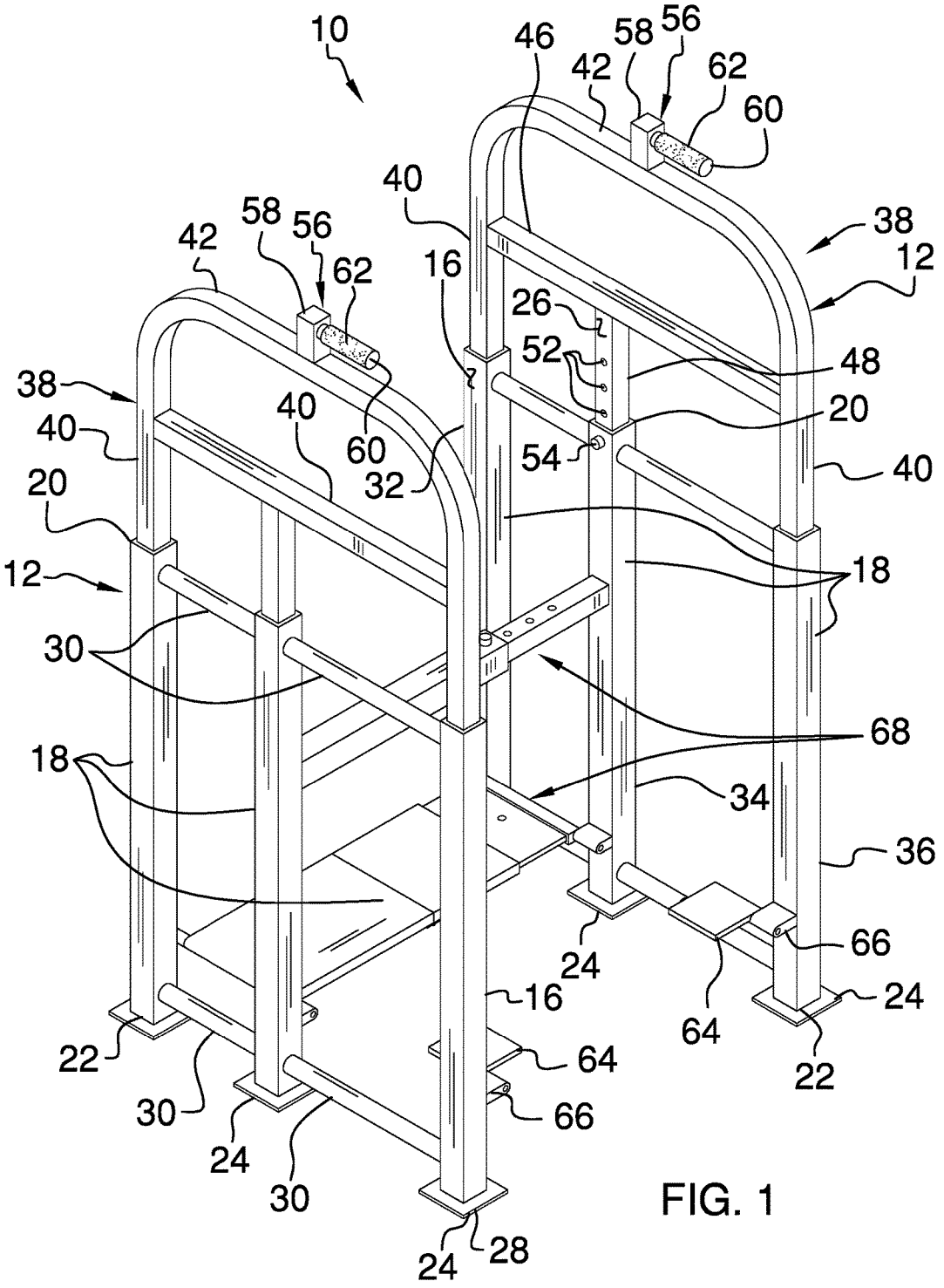
FIG. 1 is a front perspective view of a collapsible exercise assembly according to an embodiment of the disclosure.
Figure 2:
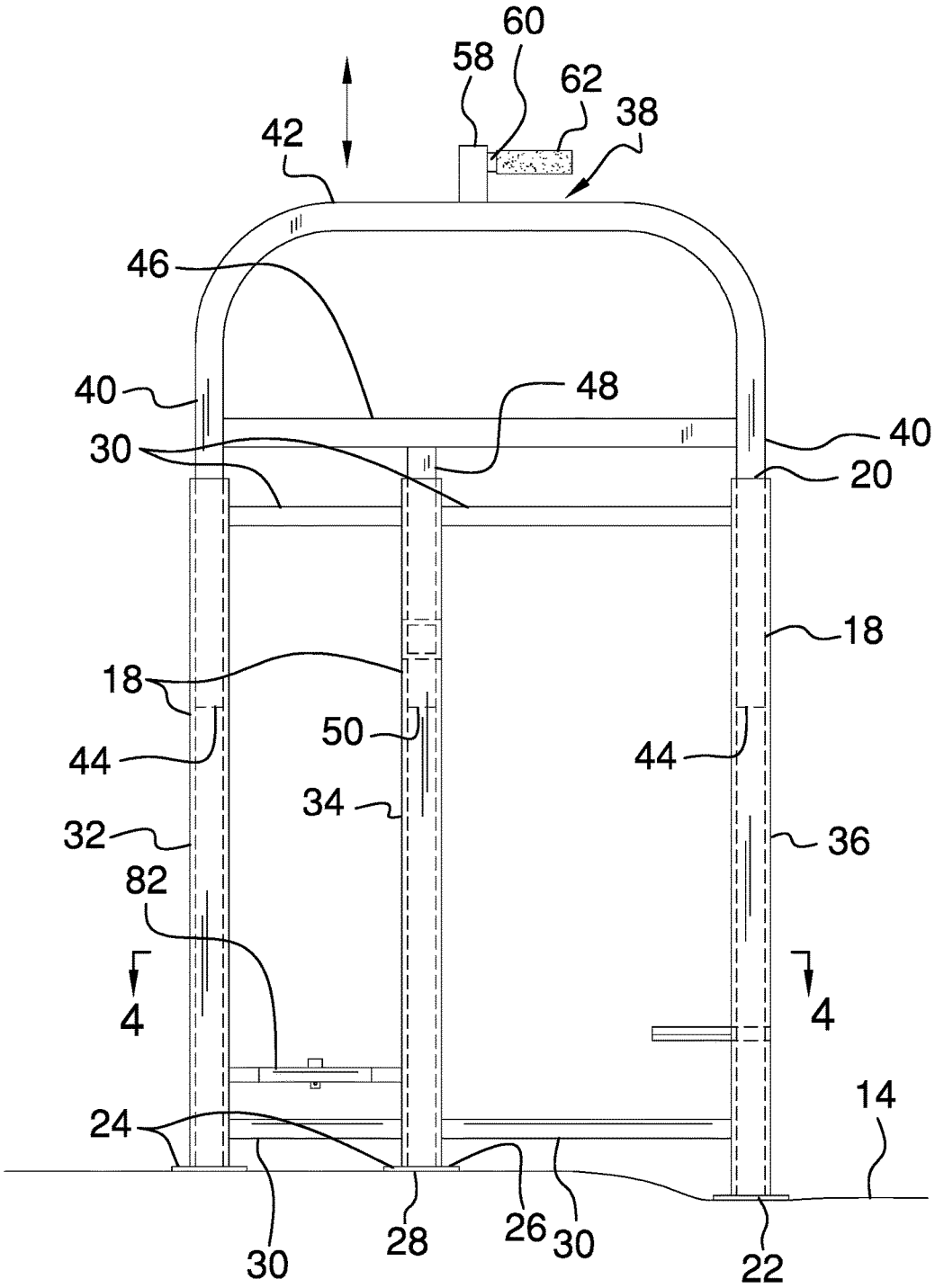
FIG. 2 is a left side phantom view of an embodiment of the disclosure.
Figure 3:
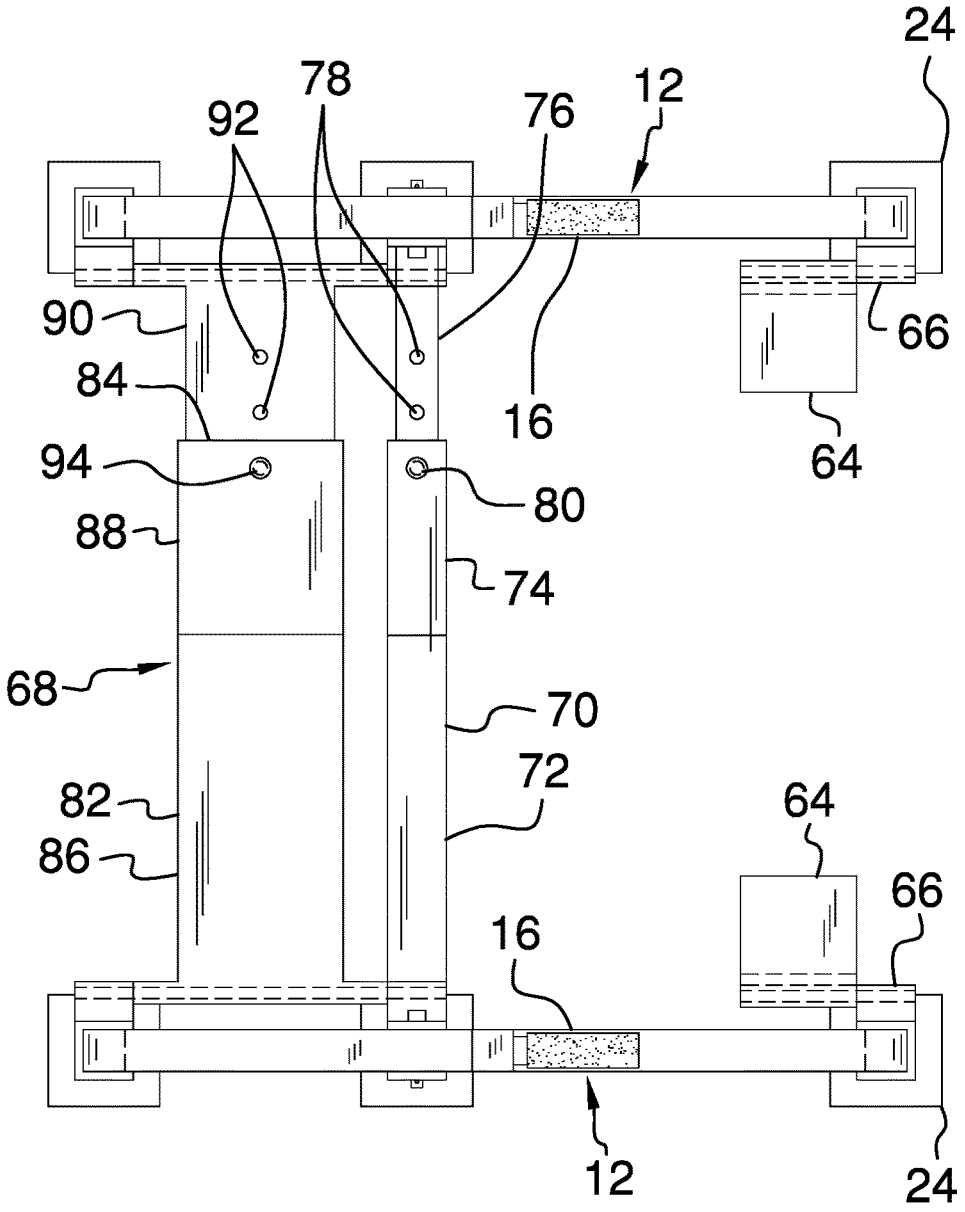
FIG. 3 is a top view of an embodiment of the disclosure.
Figure 4:
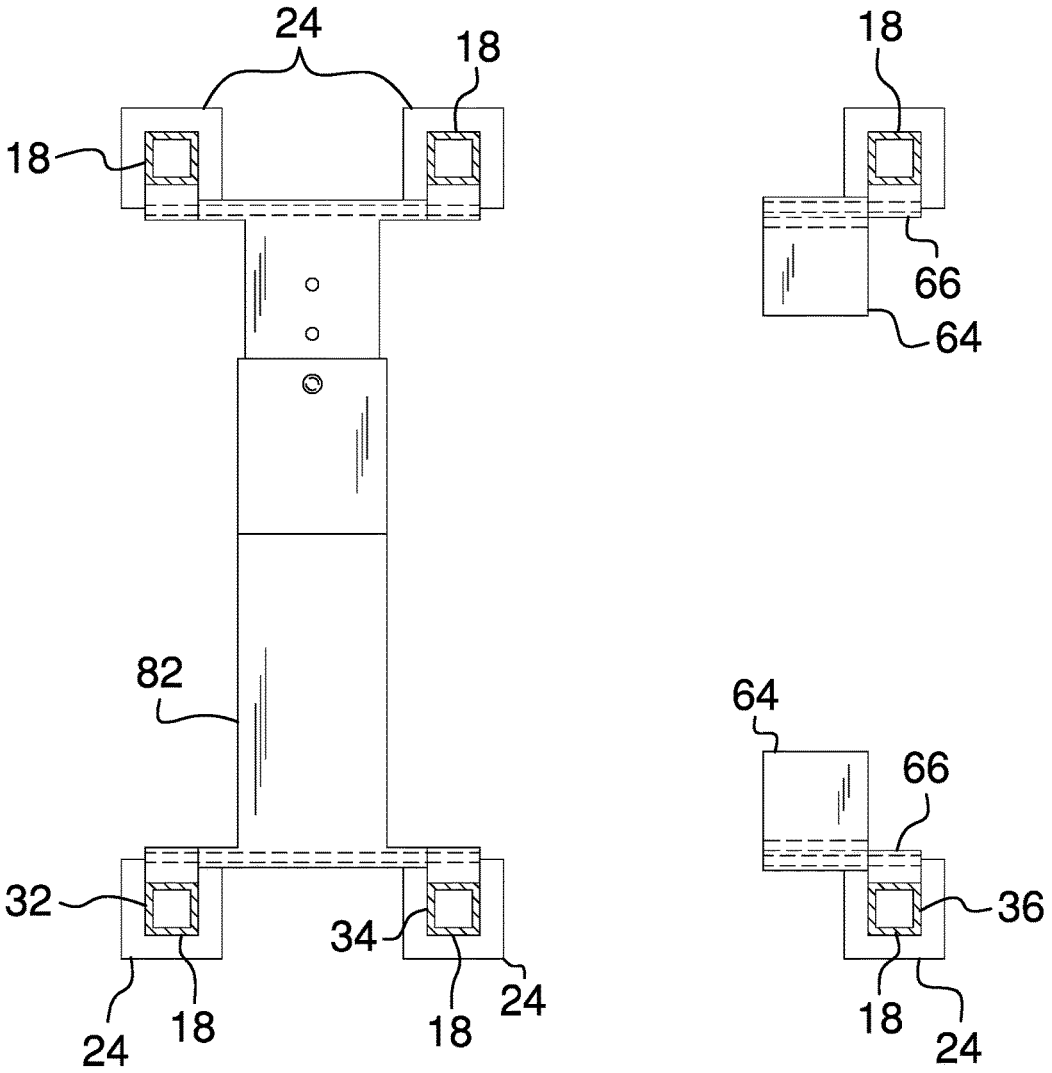
FIG. 4 is a cross sectional view taken along line 4-4 of FIG. 2 of an embodiment of the disclosure.
Figure 5:
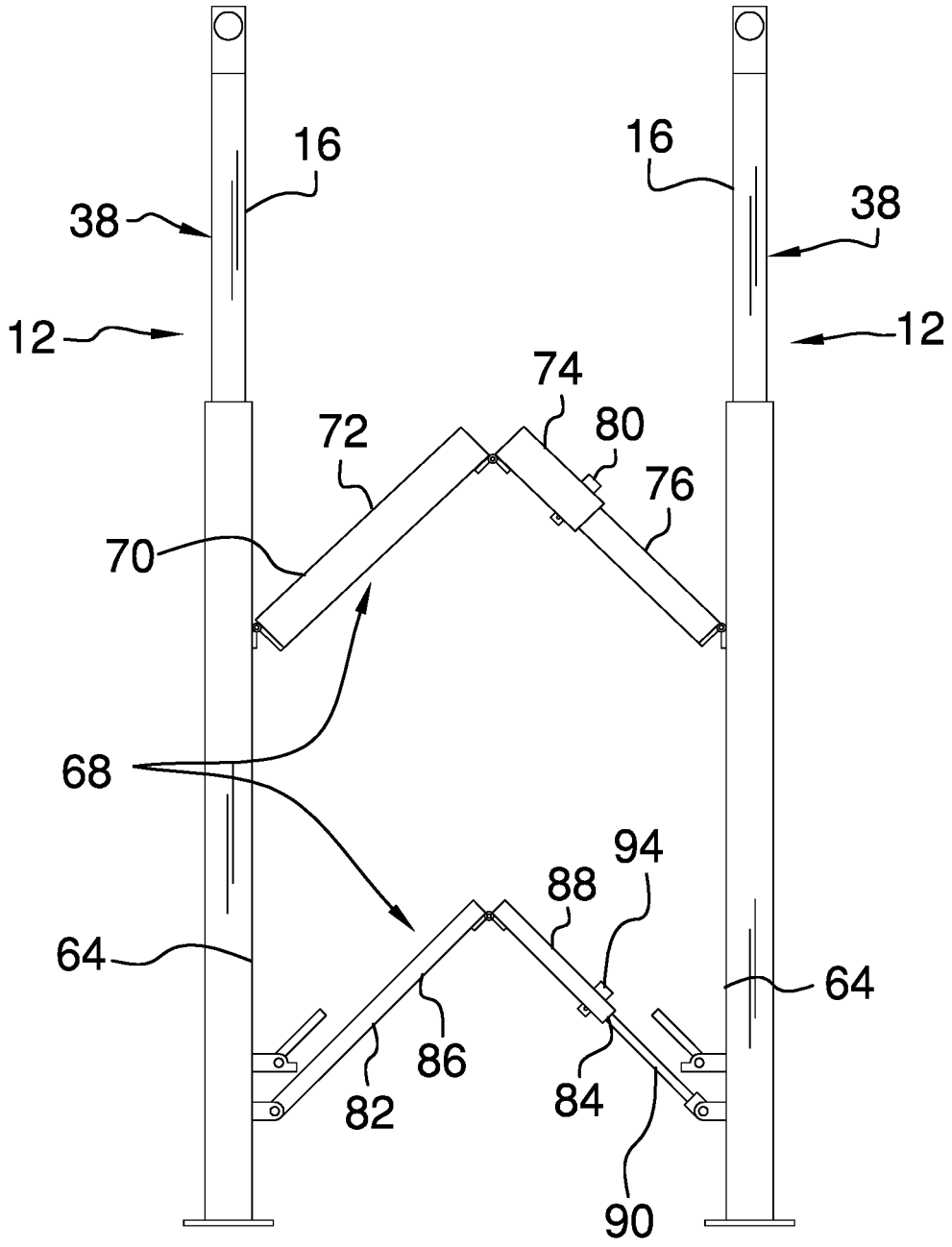
FIG. 5 is a front view of an embodiment of the disclosure in a partially folded position.
Figure 6:
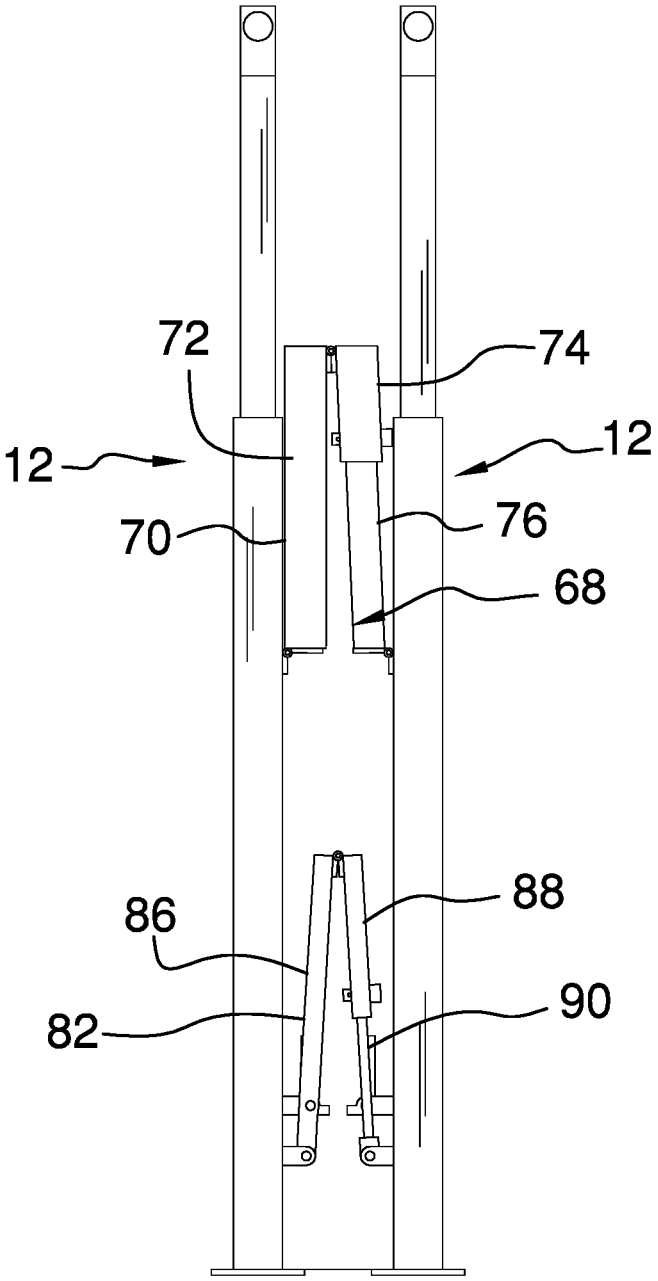
FIG. 6 is a front view of an embodiment of the disclosure in a fully folded position.

With reference now to the drawings, and in particular to FIGS. 1 through 6 thereof, a new exercise device embodying the principles and concepts of an embodiment of the disclosure and generally designated by the reference numeral 10 will be described.

As best illustrated in FIGS. 1 through 6, the collapsible exercise assembly 10 generally comprises a pair of uprights 12 and each of the uprights 12 is vertically oriented on a support surface 14. The support surface 14 may be a floor or the like and each of the uprights 12 has an inwardly facing surface 16. The uprights 12 are spaced apart from each having the inwardly facing surface 16 corresponding to each of the uprights 12 facing each other. Each of the uprights 12 is gripped thereby facilitating a user to perform dip exercises.

Each of the uprights 12 comprises a plurality of tubes 18 and each of the tubes 18 has a first end 20 and a second end 22. A plurality of plates 24 is provided and each of the plates 24 has a first surface 26 and a second surface 28. The first surface 26 corresponding to each of the plates 24 is coupled to the second end 22 of an associated one of the tubes 18. The second surface 28 abuts the support surface 14 has each of the tubes 18 extending upwardly from the support surface 14. A plurality of spacers 30 is provided and each of the spacers 30 is coupled between an associated pair of the tubes 18. In this way each of the tubes 18 is spaced apart from each other to define a first outward tube 32, a middle tube 34 and a second outward tube 36.

A support 38 is provided that has a pair of outward arms 40 and a central arm 42 extending therebetween such that the support 38 has a U-shape. Each of the outward arms 40 has a distal end 44 with respect to the central arm 42. A first arm 46 is coupled between each of the outward arms 40 and the first arm 46 is spaced from the central arm 42.

A second arm 48 is coupled to and extends downwardly from the first arm 46. The second arm 48 is centrally positioned between and is oriented collinear with each of the outward arms 40. The second arm 48 has a distal end 50 with respect to the first arm 46 and a first surface 26. The first surface 26 has a plurality of first apertures 52 extending into an interior of the second arm 48. The first apertures 52 are spaced apart from each other and are distributed along the second arm 48.

The first end 20 of the first outward tube 32 slidably receives the distal end 44 corresponding to an associated one of the outward arms 40. The first end 20 corresponding to the second outward tube 36 slidably receives the distal end 44 corresponding to an associated one of the outward arms 40. The first end 20 of the middle tube 34 slidably receives the distal end 50 of the second arm 48. A first pin 54 extends through the middle tube 34 and engages a selected one of the first apertures 52. In this way the central arm 42 is spaced a selected distance from the support surface 14 thereby inhibiting a user from hitting the support surface 14 while the user performs the dip exercises.

A pair of handles 56 is provided and each of the handles 56 is coupled to an associated one of the uprights 12. Each of the handles 56 may be gripped thereby facilitating the user to perform dip exercises. Each of the handles 56 comprises a stem 58 that is coupled to and extends upwardly from the central arm 42. The stem 58 is centrally positioned on the central arm 42. A peg 60 is coupled to and extends laterally away from the stem 58. Moreover, the peg 60 is spaced from and is oriented collinear with the central arm 42 and the peg 60 may be gripped. A pad 62 is coupled around the peg 60 and the pad 62 is comprised of a resiliently compressible material to enhance gripping the peg 60.

A pair of foot plates 64 is provided and each of the foot plates 64 is movably coupled to an associated one of the uprights 12. Each of the foot plates 64 may be stood upon thereby facilitating the user to mount the uprights 12. Each of the foot plates 64 comprises a tab 66 that is coupled to and extends away from the inwardly facing surface 16 corresponding to the second outward tube 36. The tab 66 is positioned closer to the second end 22 of the second outward tube 36 than the first end 20 of the second outward tube 36.

A folding unit 68 is coupled between the pair of uprights 12. The folding unit 68 is selectively positioned in a deployed position has the uprights 12 is spaced a maximum distance apart from each other. The folding unit 68 is selectively positioned in a folded position has each of the uprights 12 is spaced a minimum distance apart from each other.

The folding unit 68 comprises a third tube 70 that is hingedly coupled to the inwardly facing surface 16 corresponding to the middle tube 34 of an associated one of the uprights 12. Additionally, the third tube 70 is centrally positioned on the middle tube 34. The third tube 70 has a first half 72 that is hingedly coupled to a second half 74. The third tube 70 is positioned in a deployed position has the third tube 70 is oriented perpendicular to the middle tube 34 of the corresponding upright 12. Moreover, the third tube 70 is positioned in a folded position has the first half 72 forming an angle with the second half 74.

A member 76 is hingedly coupled to the inwardly facing surface 16 corresponding to the middle tube 34 of an associated one of the uprights 12. The member 76 is centrally positioned on the middle tube 34 and the member 76 has a plurality of second apertures 78 extending therethrough. The second apertures 78 are spaced apart from each other and are distributed along the member 76.

The second half 74 of the third tube 70 insertably receives the member 76. The member 76 is oriented perpendicular to the middle tube 34 of the corresponding upright when the third tube 70 is positioned in the deployed position. Moreover, the member 76 is oriented collinear with the middle tube 34 of the corresponding upright 12 when the third tube 70 is positioned in the folded position. A second pin 80 extends through the member 76 and engages an associated one of the second apertures 78 such that each of the uprights 12 is spaced a selected distance apart from each other. The second outward tube 36 is spaced from the middle tube 34 a distance that is greater than a distance between the first outward tube 32 and the middle tube 34. In this way the third tube 70 and the member 76 are inhibited from engaging the user when the user performs the dip exercises.

A first brace 82 is hingedly coupled to the inwardly facing surface 16 corresponding to each of the first outward tube 32 and the middle tube 34 of an associated one of the uprights 12. The first brace 82 has a distal end 84 with respect to the first outward tube 32 and the middle tube 34. The distal end 84 of the first brace 82 is open and the first brace 82 is substantially hollow. The first brace 82 has a primary half 86 that is hingedly coupled to a secondary half 88. The first brace 82 is positioned in a deployed position having the first brace 82 being oriented perpendicular to the first outward tube 32 and the middle tube 34.

A second brace 90 is hingedly coupled to the inwardly facing surface 16 corresponding to each of the first outward tube 32 and the middle tube 34 of an associated one of the uprights 12. The distal end 84 of the first brace 82 slidably receives the second brace 90. The second brace 90 has a plurality of third apertures 92 extending therethrough and the third apertures 92 are spaced apart from each other and distributed along the second brace 90. A third pin 94 extends through the first brace 82 and engages a selected one of the third apertures 92 such that each of the uprights 12 is spaced a selected distance apart from each other.

In use, the folding unit 68 is positioned in the deployed position. The uprights 12 are spaced a selected distance apart from each other based on the user's preferences. The second pin 80 is manipulated to engage a selected one of the second apertures 78 and the third pin 94 is manipulated to engage a selected one of the third apertures 92. In this way the uprights 12 are retained the selected distance apart from each other. The support 38 corresponding to each of the uprights 12 is extended a selected distance upwardly on the corresponding upright. The first pin 54 is manipulated to engage a selected one of the first apertures 52 to retain the support 38 at the selected height. The user grips the peg 60 corresponding to each of the handles 56 and the user performs dip exercises. The folding unit 68 is selectively positioned in the folded position to store the uprights 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible exercise assembly being configured to facilitate a user to perform dips, said collapsible exercise assembly comprising:

a pair of uprights, each of said uprights being configured to be vertically oriented on a support surface, each of said uprights having an inwardly facing surface, said pair of uprights being spaced apart from each other having said inwardly facing surfaces of said pair of uprights facing each other, each of said uprights being configured to be gripped thereby facilitating dip exercises to be performed, each of said uprights comprising a plurality of tubes, each of said plurality of tubes having a first end and a second end, a plurality of spacers, each of said spacers being coupled between an associated pair of said plurality of tubes such that each of said plurality of tubes is spaced apart from each other to define a first outward tube, a middle tube and a second outward tube;

a pair of handles, each of said handles being coupled to an associated one of said uprights wherein each of said handles is configured to be gripped thereby facilitating the user to perform the dip exercises; and a folding unit being coupled between said pair of uprights, said folding unit being selectively positioned in a deployed position having said pair of uprights being spaced a selected distance apart from each other, said folding unit being selectively positioned in a folded position having said pair of uprights being spaced a minimum distance apart from each other, said folding unit comprising a third tube being hingedly coupled to an inwardly facing surface corresponding to said middle tube of an associated one of said uprights, said third tube being centrally positioned on said middle tube, and said third tube having a first half being hingedly coupled to a second half of said third tube, said third tube being positioned in a deployed position having said third tube being oriented perpendicular to said middle tube of a corresponding upright, said third tube being positioned in a folded position having said first half forming an angle with said second half.

2. The collapsible exercise assembly according to claim 1, each of the pair of uprights further comprises a support having a pair of outward arms and a central arm extending therebetween such that said support has a U-shape, each of said outward arms having a distal end with respect to said central arm.

3. The collapsible exercise assembly according to claim 2, each of the pair of uprights further comprises a first arm being coupled between each of said outward arms, said first arm being spaced from said central arm.

4. The collapsible exercise assembly according to claim 3, each of the pair of uprights further comprises:

a second arm being coupled to and extending downwardly from said first arm, said second arm being centrally positioned between and being oriented collinear with each of said outward arms, said second arm having a distal end with respect to said first arm; and said second arm having a first surface, said first surface having a plurality of first apertures extending into an interior of said second arm, said plurality of first apertures being spaced apart from each other and being distributed along said second arm.

5. The collapsible exercise assembly according to claim 4, wherein said first end of said first outward tube slidably receives said distal end corresponding to an associated one of said outward arms, said first end corresponding to said second outward tube slidably receiving said distal end corresponding to another one of said outward arms, said distal end of said middle tube slidably receiving said distal end of said second arm.

6. The collapsible exercise assembly according to claim 5, each of the pair of uprights further comprises a first pin extending through said middle tube and engaging a selected one of said first apertures wherein said central arm is configured to be spaced a selected distance from the support surface.

7. The collapsible exercise assembly according to claim 2, wherein each of said handles comprises:

a stem being coupled to and extending upwardly from said central arm, said stem being centrally positioned on said central arm;

a peg being coupled to and extending laterally away from said stem having said peg being spaced from and being oriented collinear with said central arm wherein said peg is configured to be gripped; and a pad being coupled around said peg, said pad being comprised of a resiliently compressible material wherein said pad is configured to enhance gripping said peg.

8. The collapsible exercise assembly according to claim 1, further comprising:

a first brace being hingedly coupled to an inwardly facing surface of each of said first outward tube and said middle tube of an associated one of said uprights, said first brace having a distal end with respect to said first outward tube and said middle tube, said distal end of said first brace being open, said first brace being hollow; and said first brace having a primary half being hingedly coupled to a secondary half of said first brace, said first brace being positioned in a deployed position having said first brace being oriented perpendicular to said first outward tube and said middle tube.

9. The collapsible exercise assembly according to claim 8, further comprising a second brace being hingedly coupled to said inwardly facing surface of each of said first outward tube and said middle tube of said associated one of said uprights, said distal end of said first brace slidably receiving said second brace, said second brace having a plurality of third apertures extending therethrough.

10. The collapsible exercise assembly according to claim 9, further comprising a third pin extending through said first brace and engaging a selected one of said third apertures such that said pair of uprights is spaced a selected distance apart.

11. The collapsible exercise assembly according to claim 1, further comprising a pair of foot plates, each of said foot plates being coupled to an associated one of said uprights wherein each of said foot plates is configured to be stood upon thereby facilitating mounting said pair of uprights.

12. The collapsible exercise assembly according to claim 11, wherein each of said foot plates includes a tab being coupled to and extending away from said inwardly facing surface corresponding to said second outward tube, said tab being positioned closer to said second end of said second outward tube than said first end of said second outward tube.

13. The collapsible exercise assembly according to claim 1, further comprising:

a member being hingedly coupled to said inwardly facing surface of said middle tube of an associated one of said uprights, said member being centrally positioned on said middle tube, said member having a plurality of second apertures extending therethrough, said plurality of second apertures being spaced apart and being distributed along said member; and said second half of said third tube insertably receiving said member, said member being oriented perpendicular to said middle tube of said associated one of said uprights when said third tube is positioned in said deployed position, said member being oriented collinear with said middle tube of said associated one of said uprights when said third tube is positioned in said folded position.

14. The collapsible exercise assembly according to claim 13, further comprising a second pin extending through said member and engaging an associated one of said second apertures such that said pair of uprights is spaced a selected distance apart.

15. The collapsible exercise assembly according to claim 1, further comprising a plurality of plates, each of said plates having a first surface and a second surface, said first surface corresponding to each of said plates being coupled to said second end of a respective one of said plurality of tubes, said second surface being configured to abut the support surface having each of said plurality of tubes extending upwardly from the support surface.

16. A collapsible exercise assembly being configured to facilitate a user to perform dips, said collapsible exercise assembly comprising:

a pair of uprights, each of said uprights being configured to be vertically oriented on a support surface, each of said uprights having an inwardly facing surface, said pair of uprights being spaced apart having said inwardly facing surfaces of said pair of uprights facing each other, each of said uprights being configured to be gripped thereby facilitating dip exercises to be performed, each of said uprights comprising:

a plurality of tubes, each of said plurality of tubes having a first end and a second end, a plurality of plates, each of said plates having a first surface and a second surface, said first surface of each of said plates being coupled to said second end of a respective one of said plurality of tubes, said second surface of each of said plates being configured to abut the support surface such that each of said plurality of tubes extends upwardly from the support surface, a plurality of spacers, each of said spacers being coupled between an associated adjacent pair of said plurality of tubes such that said plurality of tubes is spaced apart to define a first outward tube, a middle tube and a second outward tube, a support having a pair of outward arms and a central arm extending therebetween such that said support has a U-shape, each of said outward arms having a distal end with respect to said central arm, a first arm being coupled between said pair of outward arms, said first arm being spaced from said central arm, a second arm being coupled to and extending downwardly from said first arm, said second arm being centrally positioned between and being oriented collinear with said pair of outward arms, said second arm having a distal end with respect to said first arm, said second arm having a first surface, said first surface having a plurality of first apertures extending into an interior of said second arm, said plurality of first apertures being spaced apart and being distributed along said second arm, said first end of said first outward tube slidably receiving said distal end of an associated one of said outward arms, said first end of said second outward tube slidably receiving said distal end corresponding to an associated one of said outward arms, said distal end of said middle tube slidably receiving said distal end of said second arm, a first pin extending through said middle tube and engaging a selected one of said first apertures wherein said central arm is configured to be spaced a selected distance from the support surface;

a pair of handles, each of said handles being coupled to an associated one of said uprights wherein each of said handles is configured to be gripped, each of said handles comprising:

a stem being coupled to and extending upwardly from said central arm, said stem being centrally positioned on said central arm, a peg being coupled to and extending laterally away from said stem having said peg being spaced from and being oriented collinear with said central arm wherein said peg is configured to be gripped, and a pad being coupled around said peg, said pad being comprised of a resiliently compressible material wherein said pad is configured to enhance gripping said peg;

a pair of foot plates, each of said foot plates being coupled to an associated one of said uprights wherein said pair of foot plates is configured to be stood upon thereby facilitating mounting said pair of uprights, each of foot plates including a tab being coupled to and extending away from an inwardly facing surface of said second outward tube, said tab being positioned closer to said second end of said second outward tube than said first end of said second outward tube, and a folding unit being coupled between said pair of uprights, said folding unit being selectively positioned in a deployed position having said uprights being spaced a maximum distance apart from each other, said folding unit being selectively positioned in a folded position having each of said uprights being space a minimum distance apart from each other, said folding unit comprising:

a third tube being hingedly coupled to an inwardly facing surface of said middle tube of an associated one of said uprights, said third tube being positioned in a folded position having said third tube being oriented collinear with said middle tube of said associated one of said uprights, said third tube being centrally positioned on said middle tube, said third tube having a first half being hingedly coupled to a second half of said third tube, said third tube being positioned in a deployed position having said third tube being oriented perpendicular to said middle tube of said associated one of said uprights, said third tube being positioned in a folded position having said first half forming an angle with said second half, a member being hingedly coupled to said inwardly facing surface corresponding to said middle tube of an associated one of said uprights, said member being centrally positioned on said middle tube, said member having a plurality of second apertures extending therethrough, said plurality of second apertures being spaced apart from each other and being distributed along said member, said second half of said third tube insertably receiving said member, said member being oriented perpendicular to said middle tube of said associated one of said uprights when said third tube is positioned in said deployed position, said member being oriented collinear with said middle tube of said corresponding upright when said third tube is positioned in said folded position, a second pin extending through said member and engaging an associated one of said second apertures such that said plurality of uprights is spaced the selected distance apart, a first brace being hingedly coupled to an inwardly facing surface corresponding to each of said first outward tube and said middle tube of an associated one of said uprights, said first brace having a distal end with respect to said first outward tube and said middle tube, said distal end of said first brace being open, said first brace being hollow, said first brace having a primary half being hingedly coupled to a secondary half, said first brace being positioned in a deployed position having said first brace being oriented perpendicular to said first outward tube and said middle tube, and a second brace being hingedly coupled to said inwardly facing surface corresponding to each of said first outward tube and said middle tube of an associated one of said uprights, said distal end of said first brace slidably receiving said second brace, said second brace having a plurality of third apertures extending therethrough, and a third pin extending through said first brace and engaging a selected one of said third apertures such that each of said uprights is spaced the selected distance apart from each other.

* * * * *